United States Patent [19]

Gerard

[11] 4,083,309

[45] Apr. 11, 1978

[54] CONTINUOUS TRANSPORT SYSTEMS

[75] Inventor: Bardet Gerard, Paris, France

[73] Assignee: Automatisme et Technique, Arcuell, France

[21] Appl. No.: 732,513

[22] Filed: Oct. 14, 1976

[30] Foreign Application Priority Data

Oct. 17, 1975 France ..... 75 31941

[51] Int. Cl.[2] ..... B61K 1/00

[52] U.S. Cl. ..... 104/18; 104/20; 104/130; 104/165; 104/173 R; 213/211

[58] Field of Search ..... 104/18, 20, 25, 88, 104/96, 130, 147 R, 165, 173 R, 245, 247; 213/75 TC, 211, 219

[56] References Cited

U.S. PATENT DOCUMENTS

| | | | |
|---|---|---|---|
| 3,037,462 | 6/1962 | Barry | 104/18 |
| 3,593,665 | 7/1971 | Marty | 104/130 X |
| 3,759,187 | 9/1973 | Gayot | 104/18X |
| 3,831,527 | 8/1974 | Peterson | 104/130 |
| 3,848,533 | 11/1974 | Grow | 104/18 |

*Primary Examiner*—Drayton E. Hoffman
*Assistant Examiner*—Randolph A. Reese
*Attorney, Agent, or Firm*—Kinzer, Plyer, Dorn & McEachran

[57] ABSTRACT

A continuous transport system characterized in that the vehicles providing passenger or goods transportation are passive vehicles without self-contained motors or braking devices, the drive for these vehicles when formed into trains being provided between stations by a head locomotive and a tail locomotive.

9 Claims, 16 Drawing Figures

F
MAR1
MAV1
R1
MAV0
RA0

MAR1
MAV1
MAV0
RA0

MAR1
RR1
MAV1
RA1
RA0

Fig. 2 b
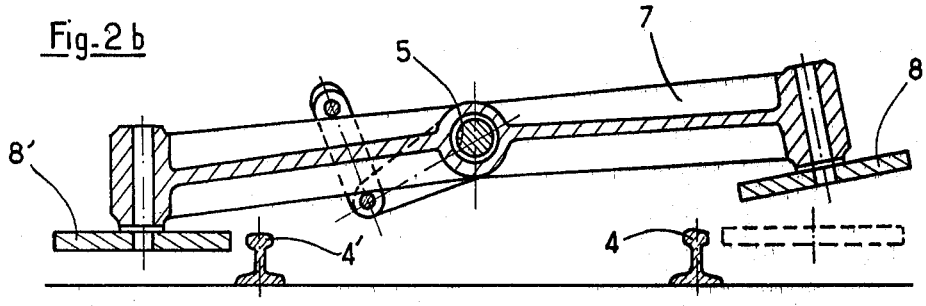
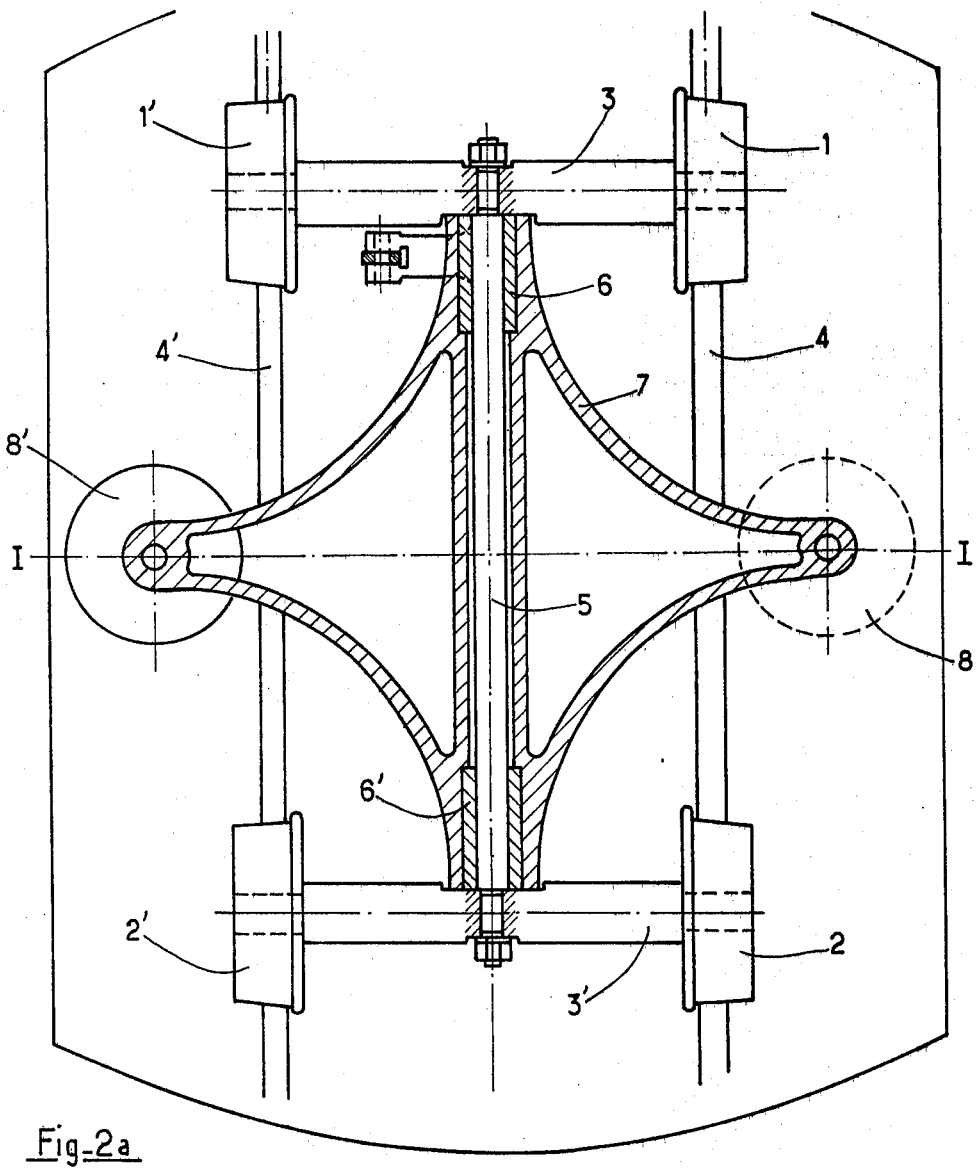
Fig. 2a

F
2'
8'
1'
4'
4'
A
4
4
B
2
8
1

F
2'
8'
1'
4'
4'
A
4
4
2
1

F
2'
1'
4'
4'
4
4
B
2
8
1

CONTINUOUS TRANSPORT SYSTEMS

The present invention relates to continuous transport systems.

In continuous transport systems of this type, the vehicles used for transporting the passengers or goods are generally all self-propelled, and are generally all provided with a self-contained braking systems, and devices which enable the distance between them and the vehicles which procede or follow them to be monitored and regulated. It follows that in these known systems, each vehicle constitutes a complex unit of high selling price, and as continuous transport systems of this type comprise a large number of low capacity vehicles to ensure good service, the corresponding cost of the overall vehicle fleet for the system is high. Furthermore, in these known continuous transport systems the vehicles generally run on special tracks the price of which is likewise very high, so further increasing the cost of the assembly. Maintenance costs for these known transport systems are likewise high because of the complexity of the vehicles and the relative complexity of the track. The high investment and maintenance costs of these known continuous transport systems in practice restrict their field of application.

According to the present invention, there is provided a continuous transport system in which vehicles are arranged to circulate in trains between stations, each of the vehicles being selectable for stopping on a branch track at a station to unload its passengers or goods and to load others, then leaving this branch track to return to the main track to join the components of another train, which may or may not immediately follow the train from which the vehicle derives, the assembly formed by such vehicles and the train components which have joined them again forming a complete train before arriving at the following station, the transport system being characterized in that the vehicles providing passenger or goods transportation are passive vehicles without self-contained motors or braking means, the drive for these vehicles when formed into trains being provided between stations by a head locomotive and a tail locomotive, the head locomotive being arranged to take during normal operations the branch track at each station, the tail locomotive being arranged to remain on the main track, the movement at the stations of the passenger and goods-carrying vehicles withdrawn from the train being provided by drive and/or brake devices situated in fixed positions along the track, these drive and/or brake devices being arranged not to act on the locomotives.

Figures 1A, 1B, 1C:
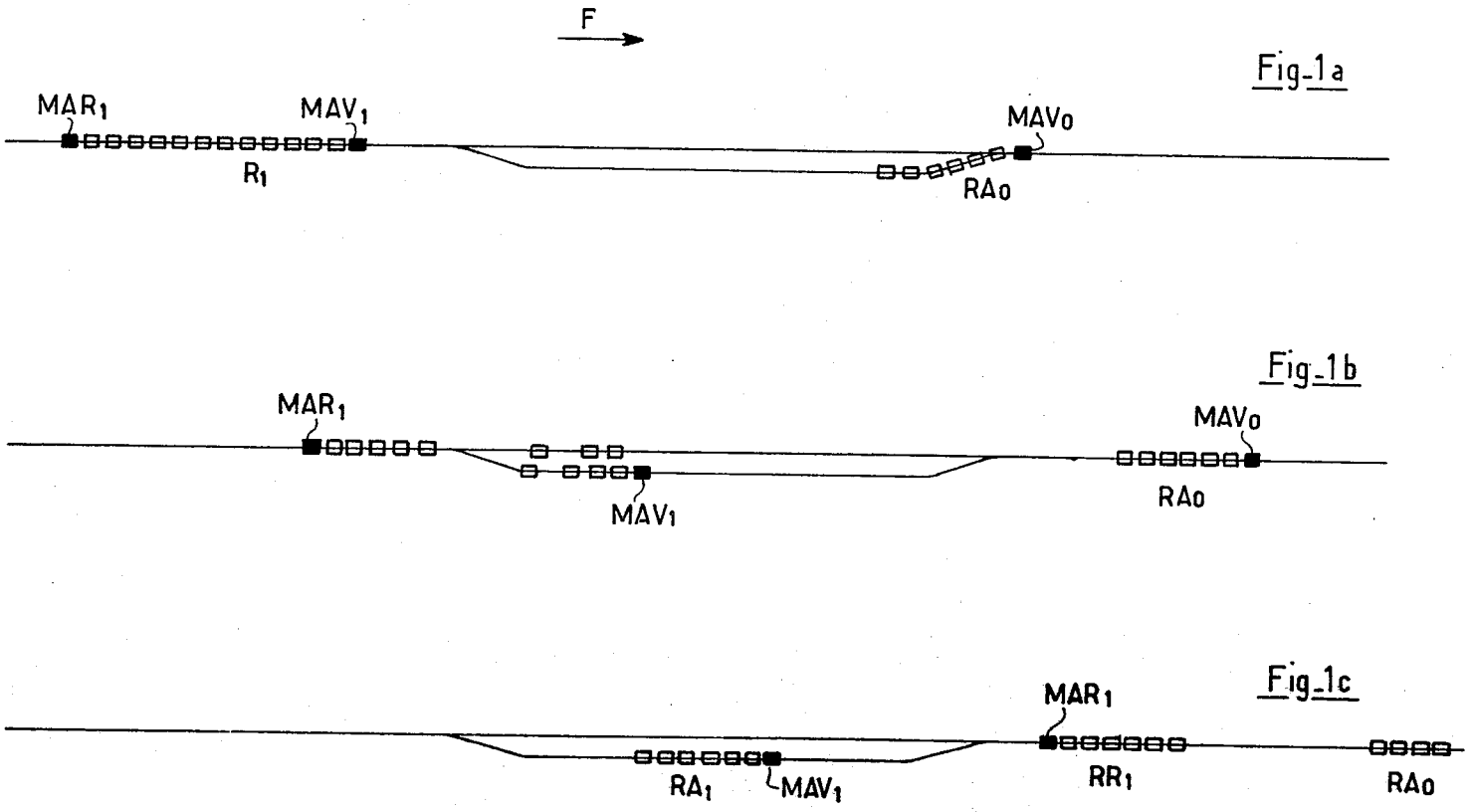
Figure 3A:
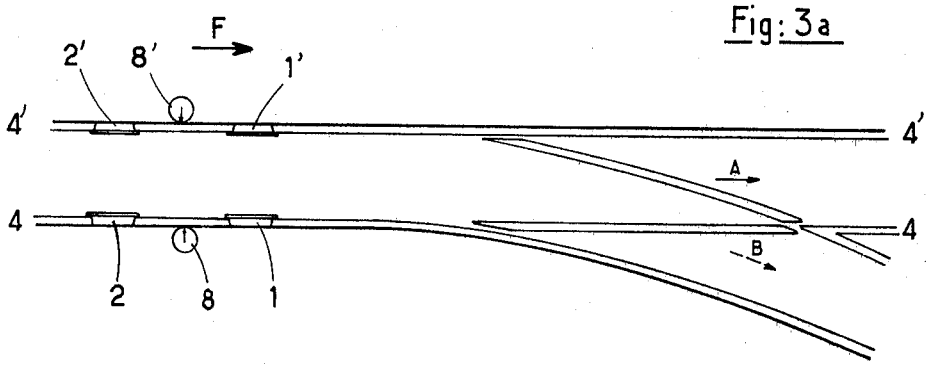
Figure 3B:
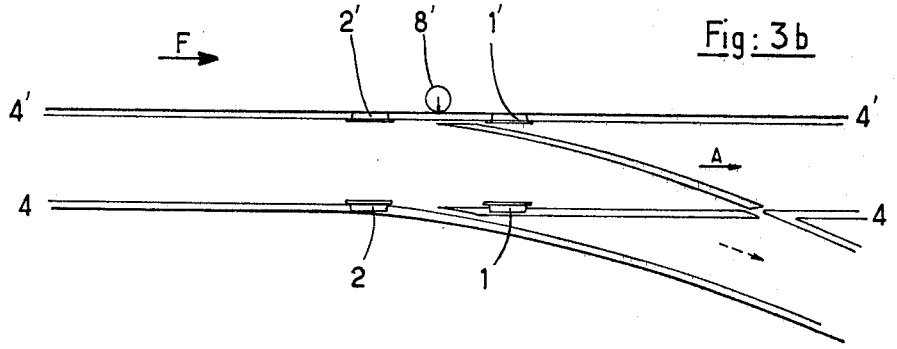
Figure 3C:
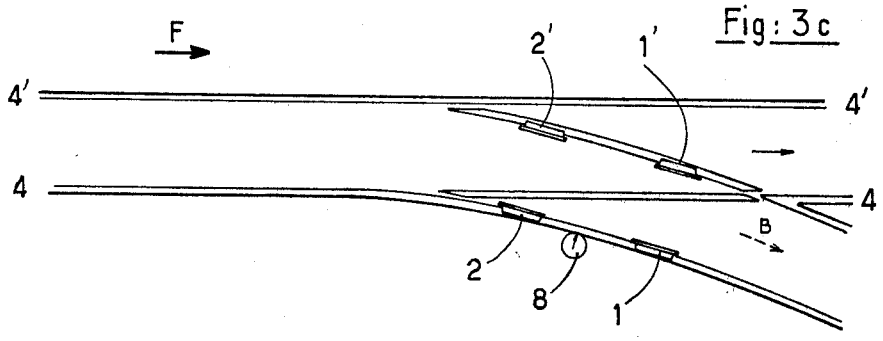
Figure 4A:
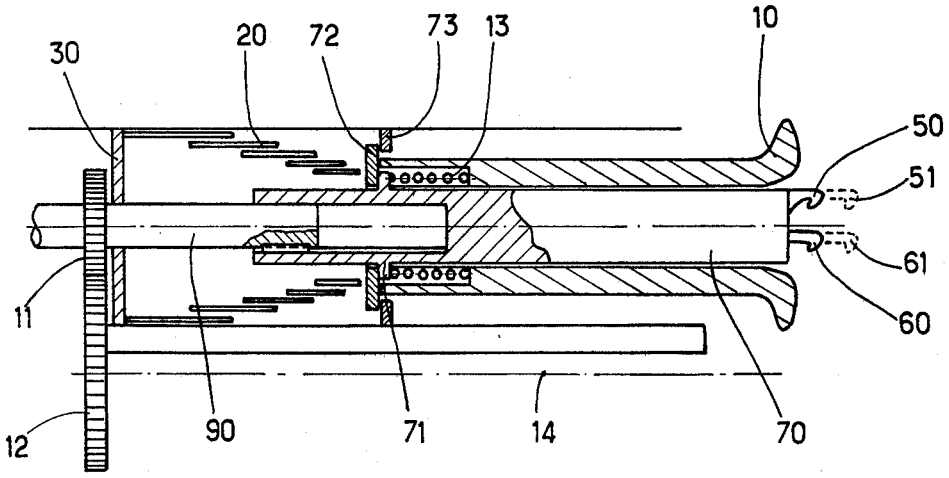
Figure 4B:
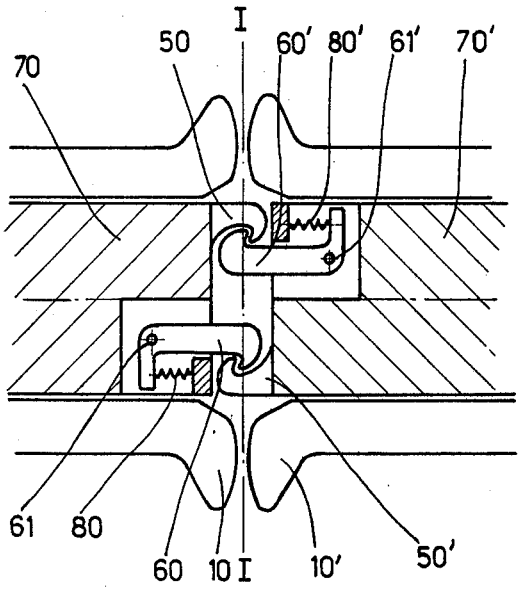
Figure 4C:
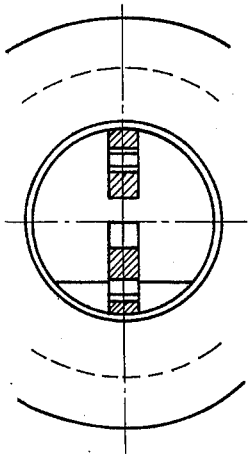
Figure 5:
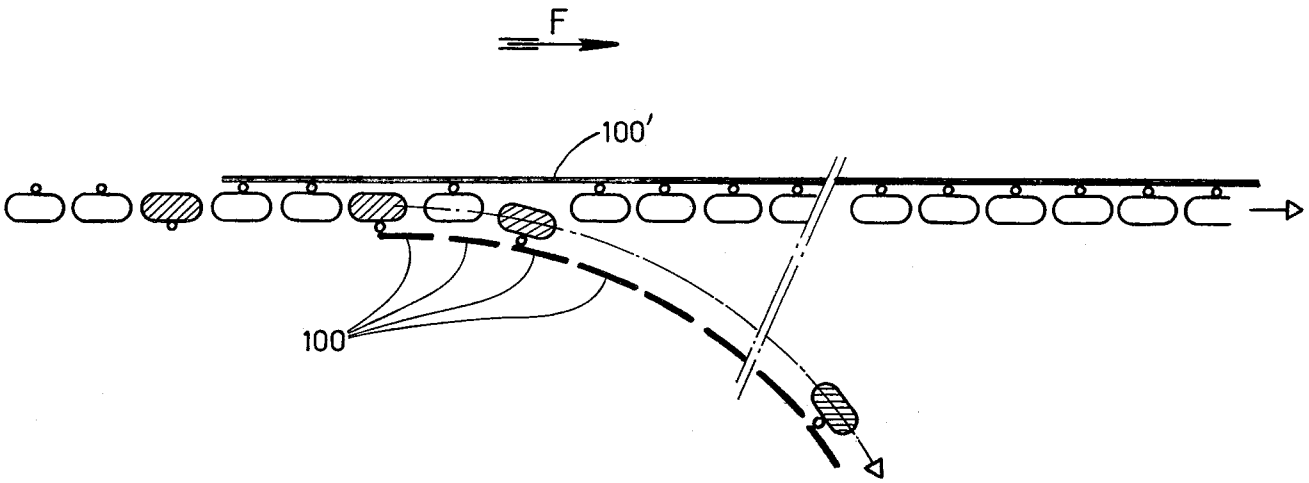
Figure 6A:
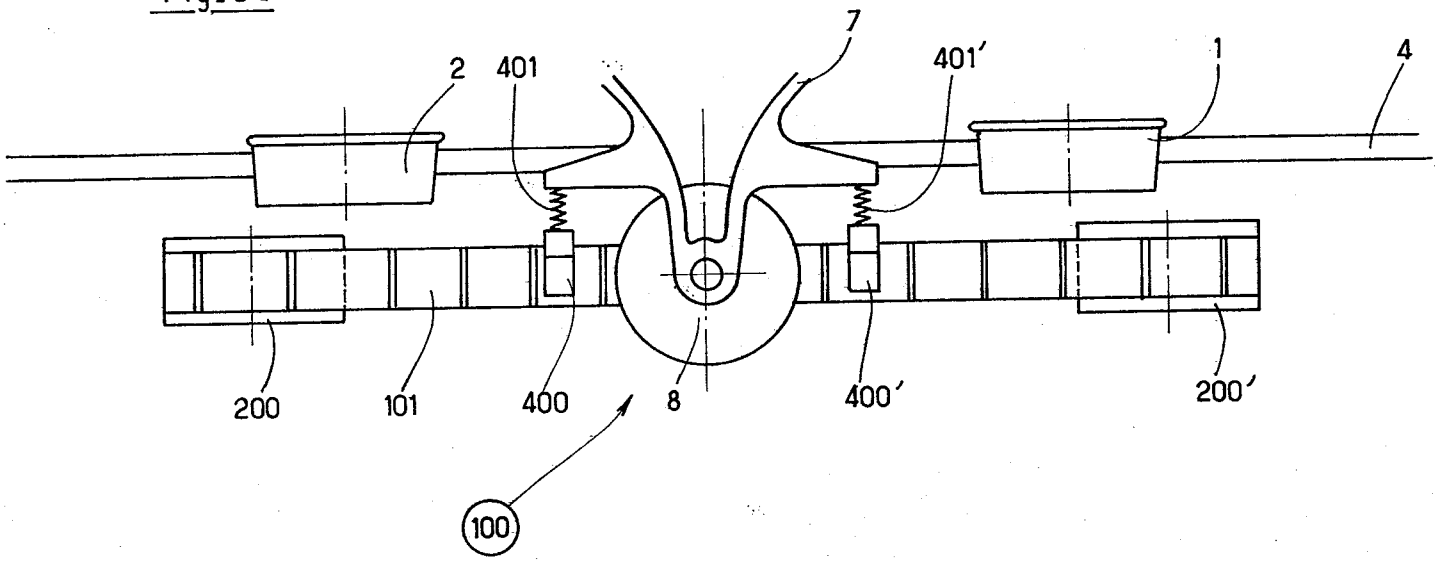
Figure 6B:
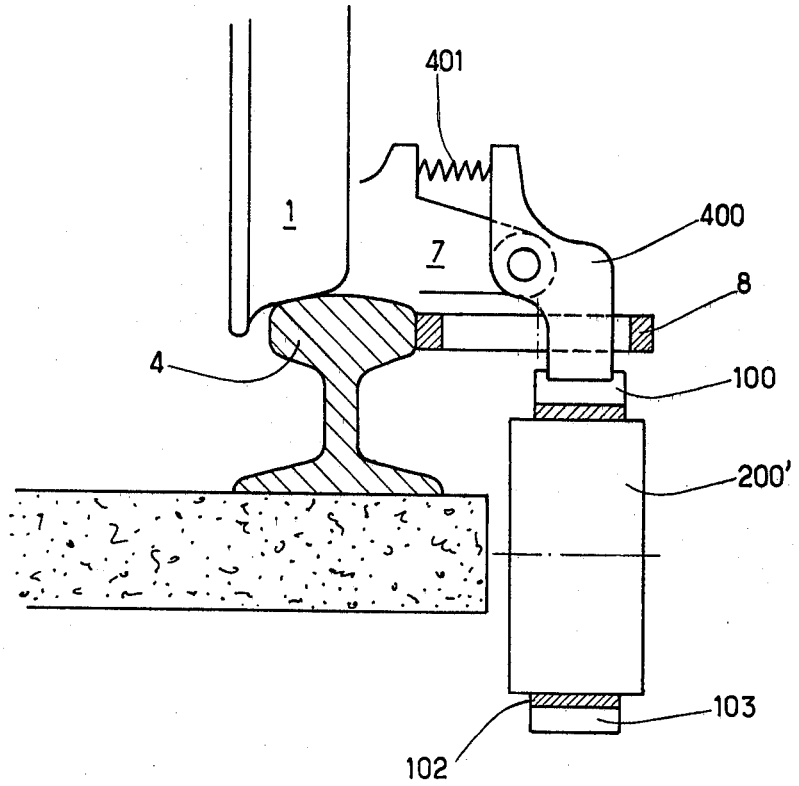
Figure 7B:
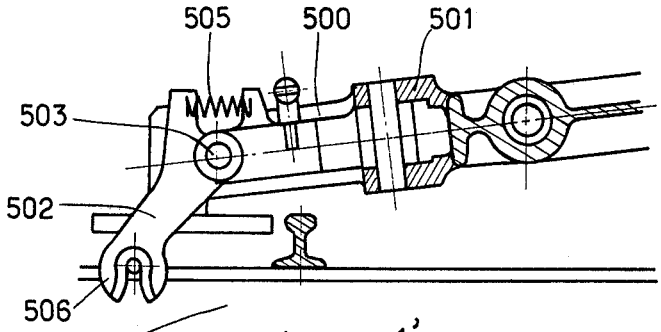
Figure 7A:
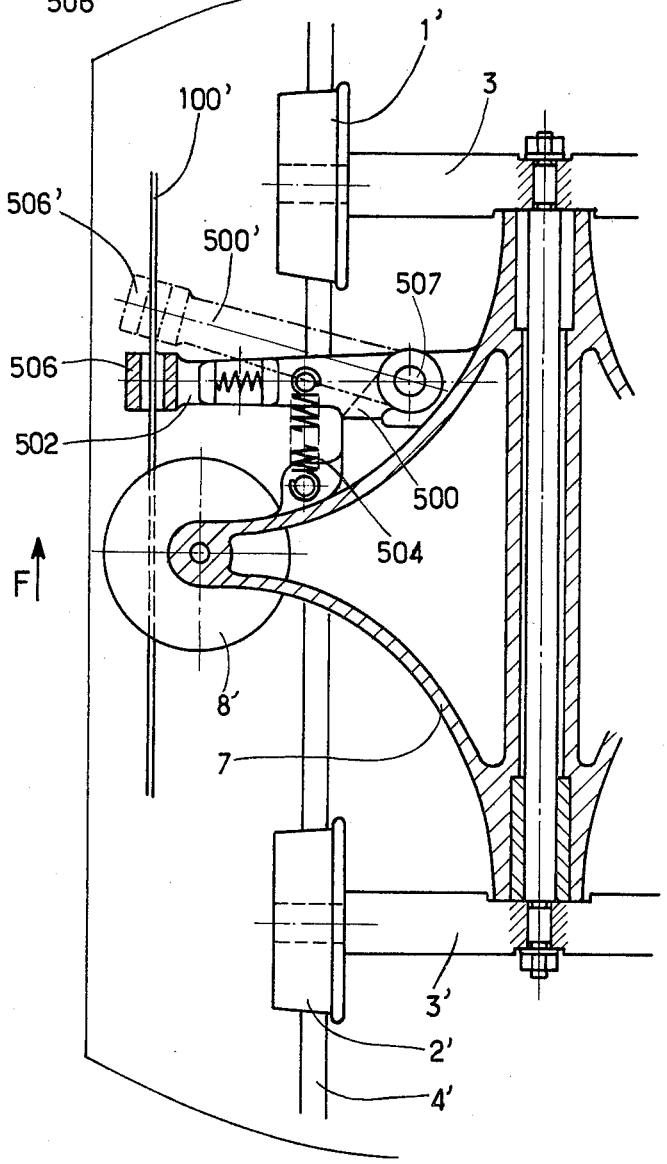

The invention will be further described, by way of example, with reference to the accompanying drawings, in which:

FIGS. 1*a* to 1*c* are diagrammatic illustrations of the principle of a preferred continuous transport system;

FIGS. 2*a* and 2*b* are a diagrammatic plan view and vertical sectional view respectively of a switching rocker arm with which each vehicle and locomotive is equipped;

FIGS. 3*a* and 3*c* show diagrammatically how the vehicles are guided at a bifurcation;

FIGS. 4*a* to 4*c* are diagrammatic representations of an automatic central buffer coupling with which the vehicles and locomotives are equipped at their two ends, FIG. 4*a* being a longitudinal section through this automatic central buffer coupling, FIG. 4*b* being a partially enlarged longitudinal section through two coupling heads, and FIG. 4*c* being a cross-section on the line I—I of FIG. 4*b*;

FIG. 5 is a diagrammatic representation of a station entrance showing devices which take over the vehicles both on the main track and on the branch track;

FIGS. 6*a* and 6*b* are diagrammatic plan and elevational views respectively of one embodiment of the devices by which the vehicles are taken over on the branch track; and FIGS. 7*a* and 7*b* are diagrammatic plan and elevational views respectively of the manner in which the vehicles, when circulating abreast of the stations on the main track, are connected to the drive device.

FIGS. 1*a* to 1*c* show the operation of a preferred continuous transport system. In FIG. 1*a*, a train $R_1$ moving in the direction of the arrow F approaches a station. This train is composed of a front locomotive $MAV_1$ and a rear locomotive $MAR_1$, and a certain number of vehicles (twelve in the example illustrated) situated between the two locomotives and driven thereby. A small train $RA_O$, composed of a front locomotive $MAV_O$ and a certain number of vehicles towed by this locomotive, is in the process of leaving the station. This small train originates from a train preceding the train $R_1$ and may or may not originate from the train immediately proceding the train $R_1$.

FIG. 1*b* shows the same locomotives and vehicles a moment later when the front locomotive $MAV_1$ has engaged with the branch track. A certain number of vehicles of the train $R_1$, and occupying any positions in this train, have also engaged with the branch track, while the other vehicles of the train $R_1$ continue on the main track. FIG. 1*c* shows the position of the various locomotives and vehicles after a further time interval. The front locomotive $MAV_1$ has stopped in the station and the various vehicles using the branch track behind it have grouped together behind it, the assembly thus forming the small train $RA_1$ on stopping. The rear locomotive $MAR_1$ has continued its journey on the main track and has left the station, pushing in front of it, after having grouped them together, the various vehicles of the train $R_1$ which remained on the main track, this assembly forming the residual train $RR_1$. This residual train $RR_1$ catches up with the small train $RA_O$, originating from the preceding train, the rear vehicles being seen together to the right of FIG. 1*c*. After the residual train $RR_1$ has caught up, the assembly formed by this latter and the small train $RR_O$ forms a complete train with its front locomotive, its rear locomotive and its vehicles situated between the two locomotives.

When the small train $RA_1$, having stopped in the station, has unloaded its passengers or goods and loaded further passengers or goods, it continues its journey and again takes up the position shown in FIG. 1*a*, but with the small train $RA_1$ replacing the small train $RA_O$, while a new train arrives upstream of the station in place of the train $R_1$ shown in FIG. 1*a*.

During the operation as heretofore described, the assembly of components making up one train circulating between two stations, namely a front locomotive, a rear locomotive and a certain number of vehicles, are all coupled together. When the train approaches a station, the front locomotive and those vehicles selected to engage with the branch track behind the front locomotive are automatically uncoupled from the rest of the train in a manner which will be described in detail hereinafter. When these vehicles again make contact with each other and with the front locomotive at rest in the station, they automatically recouple to each other and to the locomotive, so enabling this latter to tow the small train formed in this manner out of the station at the appropriate moment. Likewise, the vehicles remaining on the main track, and between which gaps will have been formed by the departure of the vehicles using the branch track, recouple to each other and to the rear locomotive when the residual train becomes regrouped. Finally, the rear vehicle of the small train deriving from a previous train and the front vehicle of the residual train which catches up with this small train downstream of the station automatically become recoupled to form a complete train.

The operation of the preferred continuous transport system may thus be summarized as follows.

Between the stations there circulate trains composed of a front locomotive, a rear locomotive and a certain number of vehicles, all these components being coupled together. On approaching a station, the front locomotive and certain vehicles are selected to engage with the branch track. These components are uncoupled from the rest of the train and when they approach the bifurcation are switched to the branch track, while all the other components comprising the train upstream of the station continue on the main track. The vehicles engaged with the branch track regroup on stopping behind the front locomotive and are automatically recoupled to each other, and to the front locomotive. The rear locomotive, by pushing them in front of itself, regroups the vehicles remaining on the main track which recouple together and to the rear locomotive to form the residual train. After leaving the station, this residual train catches up with a small train deriving from a previous train, and recouples to this small train to form a complete train.

The advantages of continuous transport systems are known. They reside essentially in the fact that at his departure station a passenger directly enters a vehicle travelling to the station at which he wishes to leave, the vehicle then passing by all intermediate stations without slowing down and without leaving the main track, to engage with the branch track in the station in which the passenger wishes to leave. This absence of intermediate stops saves the passenger considerable time on his journey, and also gives him a much more comfortable journey in the sense that he does not feel the deceleration and acceleration accompanying each intermediate stoppage in non-continuous transport systems.

In the preferred transport system, the locomotive and vehicles circulate on an ordinary rail track, for example formed from Vignole rails. However, the devices which enable the front locomotive of the train and the various vehicles occupying any positions in the train to switched to the branch track, and which enable the other vehicles and rear locomotive to be switched to the main track, are not the traditional switching devices, i.e. devices located on the track and acting by deforming it, as used at the present time in traditional railways. These devices do not enable the switching operations to be carried out with sufficient rapidity when, for example, one of the vehicles to be switched to the branch track is preceded and followed by vehicles to continue on the main track. In consequence, the switching device used in the preferred transport system is a switching device located on board, of the bistable rocker arm type. Such a switching device is known and does not form part of the present invention, but it is however desirable to quote the principle of operation for the understanding of the description given hereinafter.

FIGS. 2*a* and 2*b* are diagrammatic plan and elevational views respectively of such a device. It consists essentially of a rocker arm 7 hinged about a horizontal axis 5 lying in the longitudinal plane of symmetry of the vehicle. The vehicle is supported on rails 4 and 4' by tire and flange wheels 1 and 1', mounted on an axle 3, and by wheels 2 and 2' mounted on an axle 3'. The rocker arm 7 carries a roller, 8 8' at each of its lateral ends. When the rocker arm is in the extreme rocking position shown in FIG. 2*b*, the roller 8' is at the level of the rail 4'. In contrast, when the rocker arm 7 is in its other extreme rocking position, the roller 8 is at the level of the rail 4, in the position represented by dashes in FIG. 2*b*.

FIGS. 3*a* to 3*c* show the manner in which a vehicle or locomotive is positioned on the main or branch track. FIG. 3*a* shows a vehicle represented only by its four wheels, 1, 1', 2, 2', when the vehicle, moving in the direction of the arrow F, is upstream of a bifurcation. FIG. 3*b* shows what happens if, before reaching the bifurcation, the vehicle rocker arm is put into a position such that the roller 8' is at the level of the rail 4'. The roller 8' then compels the vehicle to follow the rail 4', i.e. to follow the main track. In contrast, if the roller 8 is lowered to the level of the rail 4 before reaching the bifurcation, the vehicle is compelled to follow the rail 4 and the vehicle thus engages with the branch track, as shown in FIG. 3*c*. These switching arrangements summarized heretofore are known, but have been described in order to facilitate understanding of the description given hereinafter.

Each of the vehicles and locomotives of the preferred transport system are equipped at their front and rear ends with an automatic central buffer coupling, one example of which is shown in FIGS. 4*a*, 4*b* and 4*c*. A central buffer 10, whose horizontal axis is in the vertical plane of longitudinal symmetry of the vehicle, rests by way of helical spring 20 against a thrust plate 30 rigid with the vehicle or locomotive chassis. When a thrust is exerted on the head of the buffer 10, for example when the vehicle or locomotive comes into contact with another vehicle or locomotive, the buffer 10 moves towards the center of the vehicle and compresses the spring 20. As the force necessary to compress the helical spring 20 increases with the path covered, this arrangement enables the kinetic energy resulting from the encounter between two vehicles or a vehicle and locomotive to be progressively absorbed. To the assembly formed by the buffer 10, spring 20 and thrust plate 30 as described, it is possible to add in known manner a "dash pot" device, not shown on the drawing, to prevent fierce action of the spring 20 which could produce troublesome longitudinal oscillation of the vehicle.

Coupling hooks 50 and 60 are mounted on a member 70 which can slide and turn in an axial bore in the buffer 10. The member 70 rests by way of a shoulder 71 on a plate 72 rigid with the buffer 10 and situated between this latter and the spring 20. An abutment 73, rigid with the vehicle or locomotive, limits displacement of the flange 72 and consequently the buffer 10 towards the end of the vehicle. A spring 13 is placed between the buffer 10 and shoulder 71 of the member 70 carrying the coupling hooks. A shaft 90 penetrates into an axial bore in the member 70. The member 70 is rotatably rigid with the shaft 90, but can slide along said shaft. The shaft 90 can be rotated by the switching rocker arm 7

(see FIG. 2*a*) rocking about the axis 14, by way of a transmission consisting for example of a train of gears 11, 12.

FIG. 4b shows to an enlarged scale two coupling heads each belonging to a different vehicle, in the relative positions which they occupy when the two vehicles are coupled together. The two buffers 10 and 10' are in contact with each other, and each of the members 70 and 70', which can slide and turn inside said buffers, carry two coupling hooks 50, 50' and 60, 60'. While the hooks 50, 50' are fixed relative to the members 70, 70', the hooks 60 and 60' can swivel about axes 61 and 61', and are urged by springs 80 and 80'. Each assembly of hooks 50, 60 and 50', 60' is situated in the vicinity of a diametrical plane of the coupling, as can be seen from FIG. 4c in which the sections through these hooks are shaded.

The described automatic central buffer coupling assembly operates in the following manner. Supposing two vehicles coupled together and forming part of one train arrive upstream of a station. The contacting coupling heads of these two vehicles are in the relative positions shown in FIGS. 4b and 4c, the coupling hook 60 being engaged with the coupling hook 50' and the coupling hook 60' being engaged with the coupling hook 50. The switching rocker arms of the two vehicles are then both in the position which switches the vehicles to the main track. Now supposing the switching rocker arm of one of the vehicles, for example the vehicle carrying the buffer 10, is put into the switching position corresponding to the branch track while the switching rocker arm of the other vehicle, carrying the buffer 10', remains in the position corresponding to the main track. The result of this operation is to turn the member 70 relative to the member 70' about their common longitudinal axis. As they rotate, the members 70 entrain the coupling hooks 50 and 60 and make them slide relative to the coupling hooks 50' and 60', so causing the hooks 50 and 60 to uncouple from the hooks 50' and 60'. In order that this uncoupling takes place with certainty, the angle of rotation of the member 70, corresponding to the stroke of the switching rocker arm between its two extreme positions, is about 90°.

In practice, before the two vehicles reach the point upstream of the bifurcation where their switching rocker arm is operated, a slight acceleration is supplied successively to each to the two vehicles, the effect of which is to slightly separate the heads of their respective buffers 10 and 10' from each other, so as to facilitate further switching of these two vehicles on to different tracks. This slight separation is made possible by the compression of the spring 13 (and its equivalent on the other vehicle), which enables the hooks 50 and 60 to reach the positions 51 and 61 shown by dashed lines in FIG. 4a. The two vehicles become uncoupled following the rotation of the member 70 relative to the member 70'. The first vehicle carrying the buffer 10' and member 70' continues on the main track, while the second vehicle carrying the buffer 10 ane member 70 engages with the branch track. It is worth mentioning here that all those vehicles of the train which, as in the case of the first vehicle considered, are to continue on the main track will have their coupling hooks in the same plane as those of the first vehicle. In contrast, all those vehicles which, as in the case of the second vehicle considered, are to engage with the branch track will have their coupling hooks in the same plane as those of the second vehicle, this plane being displaced by about 90° from the plane of the coupling hooks of the vehicles to continue on the main track.

As explained heretofore, all the vehicles to continue on the main track become regrouped to form a residual train with the rear locomotive, and at the moment of this regrouping, as the vehicles come into contact with each other and the last one of them comes into contact with the locomotive, their coupling hooks become engaged with each other just before contact between the buffers of two successive vehicles takes place. The vehicles of the residual train thus become coupled together and to the rear locomotive. Likewise, the coupling hooks of the vehicles and front locomotive which have taken the branch track become engaged with each other when the front locomotive and its vehicles become regrouped to form the small train at rest along the station platform. Thus the front locomotive becomes recoupled to the vehicles of the small train, these latter being recoupled together, so that the front locomotive is able at the required moment to tow the small train out of the station.

When the small train is caught by a residual train a certain distance after leaving the station, the reconstituted train assembly passes on to a control ramp which resets the switching rocker arms of the front locomotive and those of all the vehicles of the small train to the position which the switching rocker arms of the residual train and its rear locomotive already occupy, the effect of this being to recouple the last vehicle of the small train to the first vehicle of the residual train and thus recouple all the vehicles of the reconstituted train and their front and rear locomotives. The aforegoing description of an automatic central buffer coupling is given only by way of example, and another method of obtaining this automatic coupling could well be conceived provided it satisfies the following conditions, namely:

that two vehicles or locomotives coming into contact with each other are automatically coupled together if the position of their respective switching rocker arms is the same;

that two coupled vehicles or locomotives are automatically uncoupled if the positions of their respective switching rocker arms are different. FIG. 5 shows the entrance to a track bifurcation, and the arrangement along the main track and branch track respectively of the means which enable the vehicles withdrawn from the train to be taken over. In effect, as is seen, when the vehicles reach such a bifurcation, they could find themselves uncoupled from the vehicles or locomotive which precede or follow them. As the vehicles are passive, i.e. without motors or brakes, it is indispensable that they be governed in terms of position and seed by means lying on the track. These means are shown diagrammatically in FIG. 5 by a heavy continuous line 100' along the main track and by a dashed line 100 along the branch track. The train vehicles upstream of the fork travel in the direction of the arrow F with a determined speed V. Of these vehicles, those required to continue on the main track are shown unshaded in FIG. 5. Their switching rocker arm has been positioned in the corresponding manner, and as will be explained in detail hereinafter so it may come into engagement with the drive means 100', represented by a heavy continuous line along the main track in FIG. 5. This drive means drives the vehicles at a speed $V + \Sigma$ slightly greater than the speed V, and by doing this produces the slight acceleration mentioned heretofore, the effect of which is to slightly separate the vehicles from each other. When all the vehicles required to continue on the main track have thus been taken over by the said drive means, the rear locomotive of the train follows them, but is not acted on by the drive means shown by the heavy continuous line in FIG. 5. This rear locomotive continues on the main track with a speed pattern peculiar to itself, and which is communicated to it by a beacon placed at the entrance to the bifurcation. Thus, the rear locomotive which previously had a scheduled speed of V as did the vehicles which it pushed, accelerates to a speed $V + 2\Sigma$ slightly greater than the speed of the drive means represented by a heavy continuous line in FIG. 5. In this manner, the rear locomotive progressively catches up the vehicles located in front of it and regroups them into a residual train, as already explained.

The vehicles required to engage with the branch track are shaded in FIG. 5, and their switching rocker arms are placed in the correct position to engage with the drive means 100 represented by a heavy dashed line in FIG. 5. The first of these drive means which the vehicles encounter before reaching the actual bifurcation slightly accelerates them to the speed $V + \Sigma$ to separate the vehicles, as already described, to facilitate their switching. The initial drive elements 100 located after the bifurcation on the branch track maintain the vehicles taking this branch track at the speed $V + \Sigma$ until they have disengaged from the group of vehicles continuing on the main track. When this disengagement is obtained, the discontinuous drive elements situated along the branch track progressively brake the vehicles until they stop, so that they form the residual train along the station platform on stopping. To obtain this progressive braking, the various discontinuous drive means situated along the branch track take the vehicles from the speed $V + \Sigma$ to a speed V, then to a speed $V - \Sigma$, then to speed $V - 2\Sigma$ etc. This speed increment $\Sigma$ which may be variable from one drive element to another, is chosen so that any passengers conveyed by the vehicles do not feel any unpleasant sensations. For example, this series may be chosen so that the derivative of the deceleration with time is at most equal to 0.6 m/s/s.

The front locomotive, which was the first to engage with the branch track, is not subjected to the action of the drive means lying on the track, but obeys its own speed pattern which has been indicated to it by a beacon placed upstream of the bifurcation. This pattern is such that the locomotive engages with the fork at a speed $V + \Sigma$, then decelerates regularly until it stops.

The speeds of the front and rear locomotives and the speeds of the various portions of the drive means situated on the track are determined in such a manner that at the moment of the various regroupings between vehicles and between locomotives and vehicles, both on the main track and on the branch track, the relative speed on contact between two vehicles or between vehicles and a locomotive never exceeds a certain value, for example less than 1 m/s, so as not to create unpleasant jolts for any travellers conveyed. FIGS. *6a* and *6b* show one embodiment of a portion 100 of the discontinuous drive means disposed along the branch track. The portion 100 essentilly consists of an endless toothed belt 101 stretched between two drums 200 and 200', one of which is the drive drum. The two sides of the belt 101 so arranged are parallel to the rail 4, the upper side of the belt being situated slightly below the top of the rail (FIG. *6b*). The belt core 102 is fitted over the drums 200 et 200', while the belt teeth 103 extend radially outwards from these drums.

In FIG. *6a*, the vehicle is shown by its wheels 1, 2 which roll on the rail 4, and the end of its rocker arm 7 situated to the side of the rail 4. When this end is in the low position, i.e. when the switching roller 8 cooperates with the rail 4, two pawls 400, 400' mounted on the end of the switching rocker arm engage with the teeth 103 of the belt 100, to cause the vehicle to be driven by the belt 100. The pawls 400 and 400' are mounted resiliently with the aid of springs 401, 401', in particular to facilitate passage of the pawls from one belt element to the next. In effect, if the pawl 400' lands on the edge of a tooth when arriving at a new belt element, the compression of the spring 401' enables the pawl to act until it falls into the gap between two teeth. The length of each of the elements 100 in a direction parallel to the track is essentially equal to the length of the vehicle, so that at a given moment only one vehicle is engaged with a determined element 100. The first and last of the elements 100 are an exception to this, their length being greater than the length of a vehicle. As stated heretofore, one of the two drums 200, 200' acts as a drive drum for the toothed belt 101. This drive drum is driven by a motor, either directly or by way of a transmission where the same motor drives several successive elements 100. In all cases, a torque limiting device is inserted between the motor and drive for the element 100 or between the transmission and the drive drum for the element 100. The purpose of this torque limiting device is to prevent abnormal constraints developing in the mechanisms when, for example, two successive vehicles come into contact.

The drive element 100' extending along the main track, and represented in FIG. 5 by a heavy continuous line, may for example consist of a long endless steel cable stretched between two pulleys, one of which is the drive pulley, the upper side of the cable being supported in various places by intermediate rollers. This cable and its drive means are very similar to those used in ski lifts in ski resorts, and consequently have not been shown in detail in the drawings.

FIGS. *7a* and *7b* show how a vehicle is driven by the endless cable. The vehicle is indicated diagrammatically by its wheels 1', 2', which roll on the rail 4', its axles 3 and 3', shown only partially, and its switching rocker arm 7 which carries the switching roller 8' at its end. The vehicle moves in the direction of the arrow F. An arm 500 is hinged on the switching rocker arm, about an axis 501 perpendicular to the plane of the switching rocker arm. An arm 502 is hinged to the end of the arm 500, about a horizontal axis 503. The arm 500 is pulled towards the switching roller 8' by a tension spring 504, while the arm 502 is pushed downwards by a compression spring 505. At the free end of the arm 502 there is a fork 506 provided with a lead-in. When the switching rocker arm is in the position shown in FIG. *7b*, i.e. when disposed such that the vehicle follows the main track, the fork is engaged with the cable 100' and the base of the fork rests on the cable under the action of the compression spring 505. As the vehicle reaches the cable 100' at a speed V, and the cable 100' moves at a slightly greater speed $V + \Sigma$, the base friction of the fork 506 on the cable will displace the arm 500 about the axis 501 so that the arm 500 is brought into the position 500', the fork 506 then being in the position 506' (FIG. *7a*). In the position 506', the fork exerts a binding effect on the cable 100', so driving the vehicle at the speed $V + \Sigma$ of the cable 100'. As already stated, the rear locomotive travelling at a speed $V + 2\Sigma$ progressively catches up with the other vehicles. When it catches up with the vehicle shown in FIG. *7a,* this latter accelerates from a speed $V + \Sigma$ to the speed $V + 2\Sigma$, and thus travels more quickly than the cable 100' which always circulates at a speed $V + \Sigma$. The effect of this is to return the fork into its initial position 506 by rotating the arm 500 about the axis 501. In this position 506, there is no longer any binding effect of the fork on the cable 100', but simply friction between the cable 100' and the base of the fork 506. The cable circulating at a speed of $V + \Sigma$ thus slides in the fork which is circulating with the vehicle at a speed of $V + \Sigma$. Thus the described device drives the vehicle when this latter, on being left to itself, travels at a speed less than the speed of circulation of the cable 100', but the device becomes disengaged automatically as soon as the speed of the vehicle pushed by the rear locomotive exceeds the speed of the cable.

The locomotives do not comprise pawls 400, 400' or the fork 506 at the ends of their switching rocker arm, and thus the locomotives can engage neither with the drive means 100 nor with the drive means 100'.

The aforegoing descriptions of the drive means 100 and 100' are only given by way of example, and other drive means than those described can be imagined. For example one can envisage drive means of an electrical nature such as linear motors. With regard to the vehicles taking the branch track, any drive means which enable the vehicles to be brought progressively from a speed of $V + \Sigma$ to rest may be used. With regard to the main track, any drive means which enable the vehicles to be driven at a speed of $V + \Sigma$ over a distance sufficient to enable the rear locomotive circulating at a speed of $V + 2\Sigma$ to regroup them, may be used.

In the aforegoing description, the vehicles and locomotives have been represented diagrammatically by an arrangement of two axles and a switching rocker arm mounted on a chassis. It has not been stated whether the vehicle and locomotive cabs rest on the chassis or are suspended from the chassis, in this latter case the rails 4 and 4' being located on an aerial structure. Either arrangement is compatible with the transport system according to the invention. In practice, it is often preferable to use the suspended cab arrangement, which gives a certain number of advantages such as greater comfort for passengers, more easy insertion into an urban context, etc.

Compared with continuous transportation systems in which each vehicle is motorized and comprises its own braking system and its own system for detecting distances relative to the other vehicles, the simplified continuous transport system according to the invention gives considerable economy because of the fact that the more numerous rolling components, i.e. the vehicles, are extremely simple as they possess neither a motor, nor a braking system, nor a distance detection device, the drive, braking and safety functions being undertaken by the locomotives alone. Naturally, to undertake these various functions the locomotives possess relatively complex equipment, however their complexity is not greater than that of any the vehicles which individually undertake the same functions in known continuous transport systems, and as the number of locomotives is low in relation to the number of vehicles, the price increase of the assembly due to the locomotives is far from disturbing the economy obtained with the vehicle, and the balance remains very positive.

It must be further stated that the described continuous transport system may comprise, outside the branch track stations peculiar to this type of system, a certain number of stations situated on the main track, the system then functioning towards these main track stations as a traditional discontinuous transport system, in the sense that the entire train stops in the station. This may be obtained by controlling all the switching rocker arms of the two locomotives and all vehicles accordingly, and making the beacons situated at the head of the station transmit suitable patterns to the front and rear locomotives.

Evidently the invention is not limited to the embodiments heretofore described and represented, and from which other methods and embodiments may be derived without leaving the scope of the invention.

What we claim is:

1. In a continuous transport system in which vehicles are arranged between a head locomotive and tail locomotive to circulate in trains along a main track between stations, each vehicle being selectable for switching to and stopping at a station on a branch track, then leaving the branch track to return to the main track to join the components of another train before arriving at the next station, which may or may not immediately follow the train from which the vehicles derives, said vehicles being passive vehicles without self-contained motors or braking means, one locomotive being arranged to follow the branch track at each station and the other locomotive being arranged to remain on the main track:

driving means along the main track to continue movement of an unswitched vehicle;

decelerating means along the branch track to decelerate a vehicle switched thereto;

and driven means on each vehicle to couple either to the driving means or the deceleration means.

2. A transport system as claimed in claim 1, in which the vehicles and the locomotives are each provided with a two position rocker arm switch located on board, the rocker arm switch in one position selecting the main track and in the other position selecting the branch track.

3. A transport system as claimed in claim 2, in which each vehicle and each locomotive is provided at each of its ends with an automatic coupling means arranged to automatically couple the vehicle or locomotive to another opposed vehicle or locomotive when it comes into contact therewith if the two rocker arm switches are in the same position, and to uncouple the vehicle or locomotive from another vehicle or locomotive to which it had previously been coupled when the two switcing rocker arms assume different positions.

4. A transport system as claimed in claim 3, in which each automatic coupling device is of the central buffer type, comprising a central buffer associated with a resilient device and a damping device, a member arranged to slide and turn in an axial bore in the buffer, two coupling pawls on said member at the end close to the head of the buffer, one of the coupling pawls being fixed relative to said member, the other of the coupling pawls being pivotally mounted on said member so the pivotal pawls may couple respectively to the fixed pawls upon engagement, the two coupling pawls mounted on any one member being in the same diametrical plane relative to the turning axis of the member, and means to rotate said member to uncouple the pawls when a switching rocker arm passes from one position to the other.

5. A transport system as claimed in claim 1 in which the driving means provided along the main track is arranged to provide a drive of uniform speed which is higher than the speed at which the unswitched vehicle engages with said driving means but lower than the speed at which the rear locomotive travels so as to catch up with other vehicles on the main track, the driven means related to said driving means being arranged to uncouple from said driving means when the unswitched vehicle is accelerated by the rear locomotive.

6. A transport system as claimed in claim 1 in which each driving means comprises an endless cable arranged to circulate at uniform speed, a clamp engageable with the cable and pivotally mounted at the end of a switching rocker arm in such a manner that the clamp binds on the cable to accelerate the unswitched vehicle if the speed of the cable is greater than the unswitched vehicle speed.

7. A transport system as claimed in claim 1 in which there are a plurality of decelerating means provided along the branch track to impart to the switched vehicle successively decreasing speeds so as to stop the switched vehicle at a station.

8. A transport system as claimed in claim 7 in which each of the decelerating means comprises an externally toothes belt stretched between two drums, one of which is arranged to drive the belt, each of the vehicles being provided with pawls resiliently mounted at the end of the switching rocker arm and arranged to engage the teeth of the belt.

9. A transport system as claimed in claim 7 in which the driving means provided along the main track is arranged to provide a drive of uniform speed which is higher than the speed at which the unswitched vehicle engages with said driving means but lower than the speed at which the rear locomotive travels so as to catch up with other vehicles on the main track, the driven means related to said driving means being arranged to uncouple from said driving means when the unswitched vehicle is accelerated by the rear locomotive.

* * * * *